US011857125B1

(12) United States Patent
De Silva et al.

(10) Patent No.: US 11,857,125 B1
(45) Date of Patent: Jan. 2, 2024

(54) LIQUID PRODUCT DISPENSER AND MOUNTING DEVICE

(71) Applicants: Anuradha Andy De Silva, Ranchos Palos Verdes, CA (US); Shehan James, Los Angeles, CA (US); Dinesh Weerasekera, Fullerton, CA (US)

(72) Inventors: Anuradha Andy De Silva, Ranchos Palos Verdes, CA (US); Shehan James, Los Angeles, CA (US); Dinesh Weerasekera, Fullerton, CA (US)

( * ) Notice: Subject to any disclaimer, the term of this patent is extended or adjusted under 35 U.S.C. 154(b) by 0 days.

(21) Appl. No.: 18/112,144

(22) Filed: Feb. 21, 2023

(51) Int. Cl.
*A47K 5/12* (2006.01)

(52) U.S. Cl.
CPC ..... *A47K 5/12* (2013.01); *A47K 2005/1218* (2013.01)

(58) Field of Classification Search
CPC ..... A47K 2005/1218; A47K 2201/102; A47K 5/12; A47K 5/122
See application file for complete search history.

(56) References Cited

U.S. PATENT DOCUMENTS

| | | | | |
|---|---|---|---|---|
| 6,041,974 | A * | 3/2000 | Poitras | A47K 5/12 222/173 |
| 11,357,365 | B2 * | 6/2022 | Li | A47K 5/12 |
| 2006/0124811 | A1 * | 6/2006 | Tatarsky | A47B 96/067 248/220.31 |
| 2015/0083754 | A1 * | 3/2015 | Proper | A47K 5/12 222/180 |
| 2021/0113030 | A1 * | 4/2021 | Li | A47K 5/1211 |
| 2022/0225845 | A1 * | 7/2022 | Steinmetz | F16M 11/08 |

* cited by examiner

*Primary Examiner* — Jeremy Carroll
(74) *Attorney, Agent, or Firm* — Eric Karich; Karich & Associates

(57) ABSTRACT

A mounting device has a locking housing with a locking arm that pivots between an open, unlocked position, and a closed, locked position. The locking arm extending to a latch end having a latch hole. A bottom end of the dispensing container is placed within a container receiving space of the locking housing, and the locking arm is moved to the closed, locked position to engage the annular groove of the dispensing container to lock the dispensing container within the locking housing. The device further includes a magnetic locking mechanism for locking the locking arm in the closed, locked position.

4 Claims, 5 Drawing Sheets

LIQUID PRODUCT DISPENSER AND MOUNTING DEVICE

BACKGROUND OF THE INVENTION

Field of the Invention

This invention relates generally to liquid product dispensers for dispensing soap, lotion, and similar liquid products, and in particular a mounting device for mounting a liquid product dispenser on a counter-top in a hotel room or similar environment.

Description of Related Art

Dispensers of liquid products such as hand soap, lotion, shampoo, conditioner, and similar products are commonly provided in hotel rooms for the use of guests. To prevent the guests from removing the liquid products, the containers are commonly removably locked into a wall or other surface with some form of locking mechanism.

Li, U.S. Pat. No. 11,357,365, for example, teaches a soap dispenser that is adapted to be mounted on a wall of a hotel bathroom. The dispenser includes bottles for containing shampoo or shower gel and a locking mechanism that locks the bottles onto a mounting system. A magnetic locking mechanism is also included, which includes a post for interlocking with a latch for locking the locking mechanism. The post is biased upwardly by a spring, and the bias of the spring may be overcome with an unlocking magnet positioned below the locking mechanism.

The prior art teaches a soap dispenser for mounting a soap dispenser on a wall. However, magnetic locking mechanism used in the prior art requires the use of a spring to bias a locking post into an unlocked position. The requirement of including a spring contributes to a higher cost of manufacture and assembly of the final product. The prior art does not teach a liquid product dispenser that includes an improved locking mechanism that does not require the use of a spring. The present invention fulfills these needs and provides further advantages as described in the following summary.

SUMMARY OF THE INVENTION

The present invention teaches certain benefits in construction and use which give rise to the objectives described below.

The present invention provides a mounting device for mounting a liquid product dispenser onto a counter-top. The mounting device includes a locking housing having a locking arm that pivots between an open, unlocked position, and a closed, locked position. The locking arm extending to a latch end having a latch hole. A bottom end of the dispensing container is placed within a container receiving space of the locking housing, and the locking arm is moved to the closed, locked position to engage the annular groove of the dispensing container to lock the dispensing container within the locking housing. The device further includes a magnetic locking mechanism for locking the locking arm in the closed, locked position.

In another embodiment, the locking housing further includes a product dispenser for dispensing a liquid from a counter-top. The product dispenser further includes a dispensing container for containing and dispensing the liquid, the dispensing container having an annular groove adjacent a bottom end of the dispensing container.

A primary objective of the present invention is to provide a mounting device having advantages not taught by the prior art.

Another objective is to provide a mounting device that includes a magnetic locking mechanism that is less expensive to manufacture.

A further objective is to provide a liquid product dispenser that is less expensive, and which can be easily mounted onto a counter-top, such as a vanity commonly provided in hotel rooms, or similar short term rentals.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention.

DETAILED DESCRIPTION OF THE INVENTION

The above-described drawing figures illustrate the invention, a liquid product dispenser for dispensing a liquid from a surface such as a counter-top.

Figure 1:
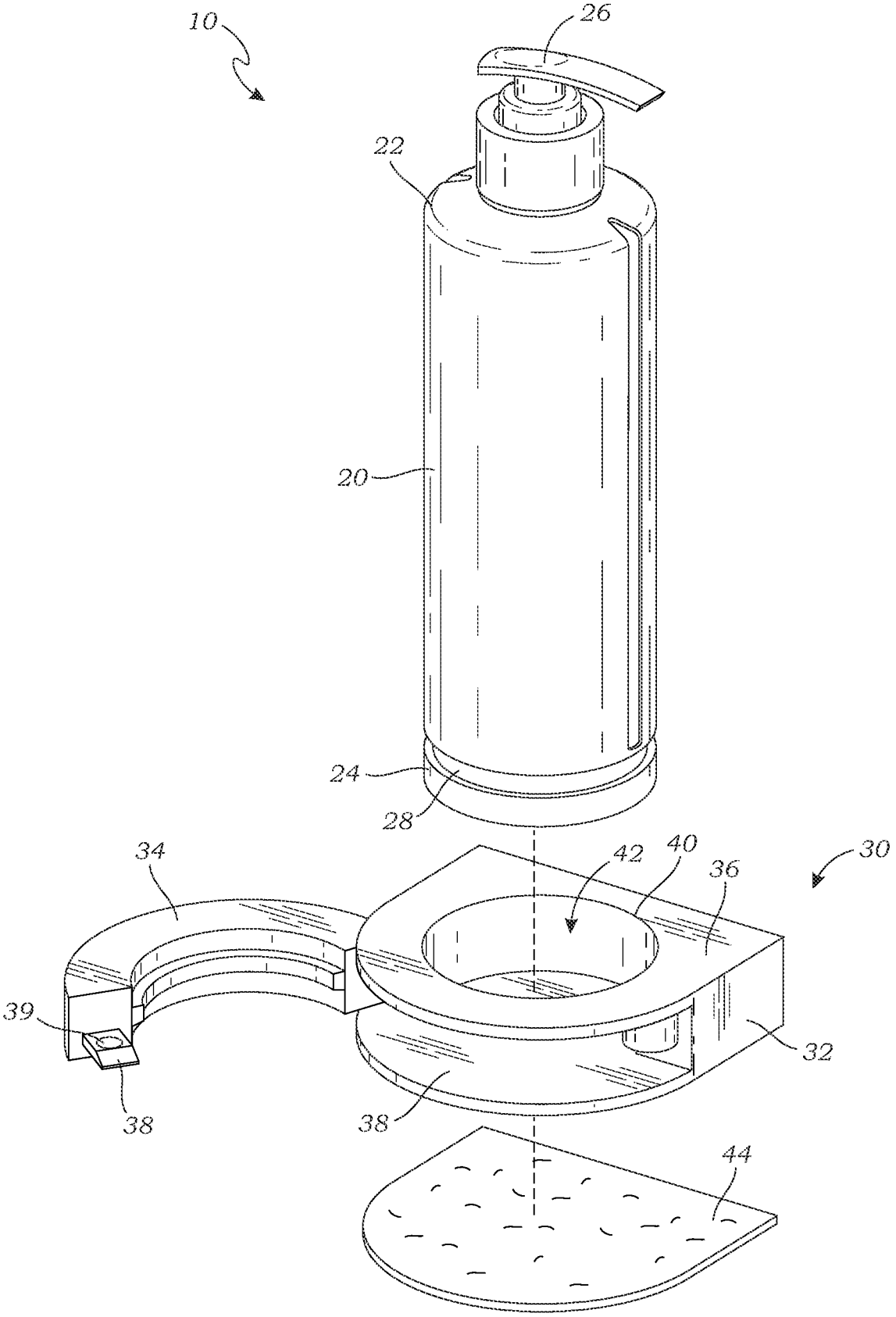
FIG. 1 is an exploded perspective view of a liquid product dispenser according to one embodiment of the present invention, illustrating a dispensing container and a locking housing, with a locking arm of the locking housing being shown in an open, unlocked position.
Figure 2:
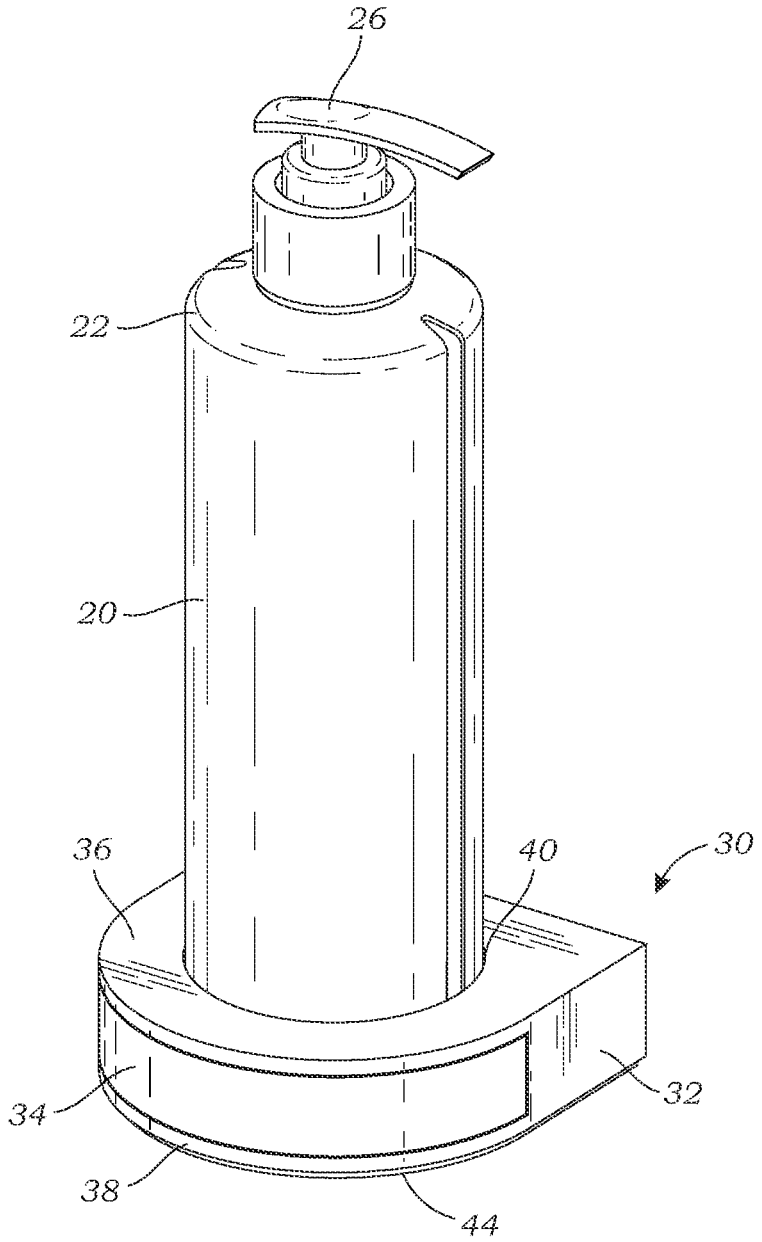
FIG. 2 is a perspective view of the liquid product dispenser of FIG. 1, illustrating the dispensing container locked within the locking housing, with the locking arm shown in a closed, locked position.

FIG. 1 is an exploded perspective view of a liquid product dispenser 10 according to one embodiment of the present invention. As shown in FIG. 1, the product dispenser 10 includes a dispensing container 20 and a mounting device 30 for mounting the dispensing container 20 on a surface such as a counter-top. The mounting device 30 includes a locking housing 32 that includes a locking arm 34 that is shown, in FIG. 1, in an open, unlocked position. FIG. 2 is a perspective view of the liquid product dispenser 10 of FIG. 1, illustrating the dispensing container 20 locked within the locking housing 32, with the locking arm 34 shown in a closed, locked position, locking the dispensing container 20 within the locking housing 32, thereby preventing unauthorized removal of the dispensing container 20.

As shown in FIGS. 1-2, the dispensing container 20 is some form of container for containing and dispensing the liquid product. For purposes of this application, the term "container" is broadly defined to include any form of bottle, flask, bowl, receptacle, canister, cartridge, or other structure known in the art for containing and dispensing a liquid. The term "liquid product" is also broadly defined to include any form of liquid product, such as soap, lotion, shampoo, conditioner, or any other similar product known in the art.

As best shown in FIG. 1, the dispensing container 20 has a top end 22 and a bottom end 24. The top end 22 may have a dispensing mechanism 26 (e.g., pump, or any other mechanism known in the art. The bottom end 24 includes an annular groove 28 adjacent a bottom end of the dispensing container 20. For purposes of this application, the term "annular groove" is broadly defined to include any form of groove or grooves, ridge or ridges, posts or other forms of protrusions or recesses, or any other structure or structures that are formed or mounted at the bottom end of the container which can interlock with the mounting device 30, as described below, so that the dispensing container 20 cannot be readily removed without physical damage to the mounting device 30 or the dispensing container 20.

As best shown in FIG. 1, the mounting device 30 includes a locking housing 32 having a top structure 34 and a bottom structure separated by a locking arm 34 that is pivotally connected to the locking housing 32 via a pivot (e.g., any form of hinge), so that the locking arm 34 pivots between an open, unlocked position, and a closed, locked position. The locking arm 34 extends to a latch end 38 having a latch hole 39. The latch hole 39 is used for locking the locking arm 34 in the closed, locked position, as discussed below.

The locking housing 32 has an opening 40 in the top structure 36 that allows access to a container receiving space 42 that is sized and shaped to receive the bottom end 24 of the dispensing container 20 therein. When the bottom end 24 of the dispensing container 20 is placed within the container receiving space 42, and the locking arm 34 is moved to the closed, locked position, the locking arm 34 engages the annular groove 28 of the dispensing container 20 to lock the dispensing container 20 within the locking housing 32.

As shown in FIG. 1, in this embodiment the locking housing 32 further includes an adhesive sheet 44 (i.e., double sided adhesive tape, or other form of adhesive material, or other suitable mounting mechanism known in the art) bonded to a bottom surface of the bottom structure, for bonding the locking housing 32 to the counter-top.

Figure 3:
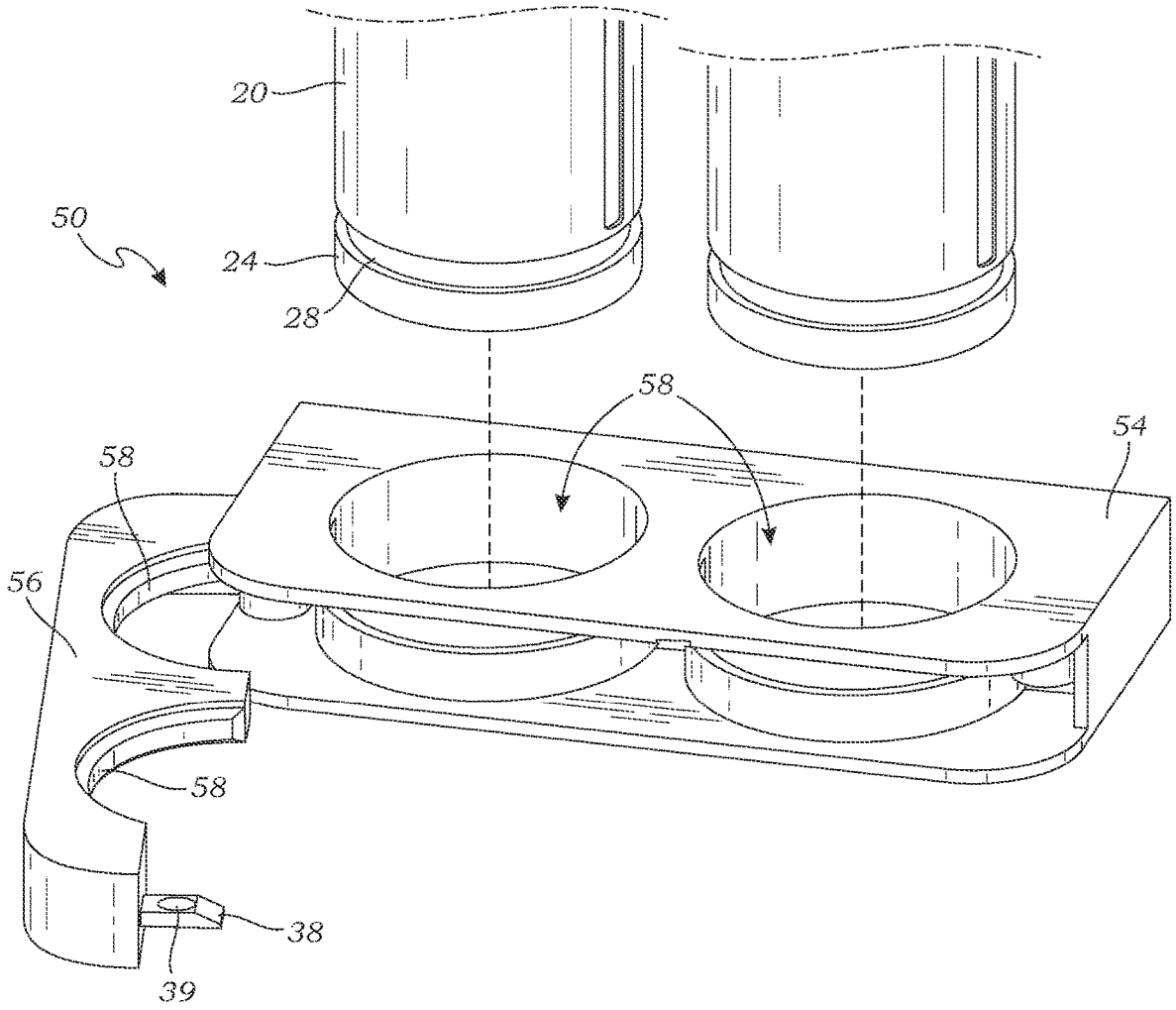
FIG. 3 an exploded perspective view of a second embodiment of the liquid product.
Figure 4:
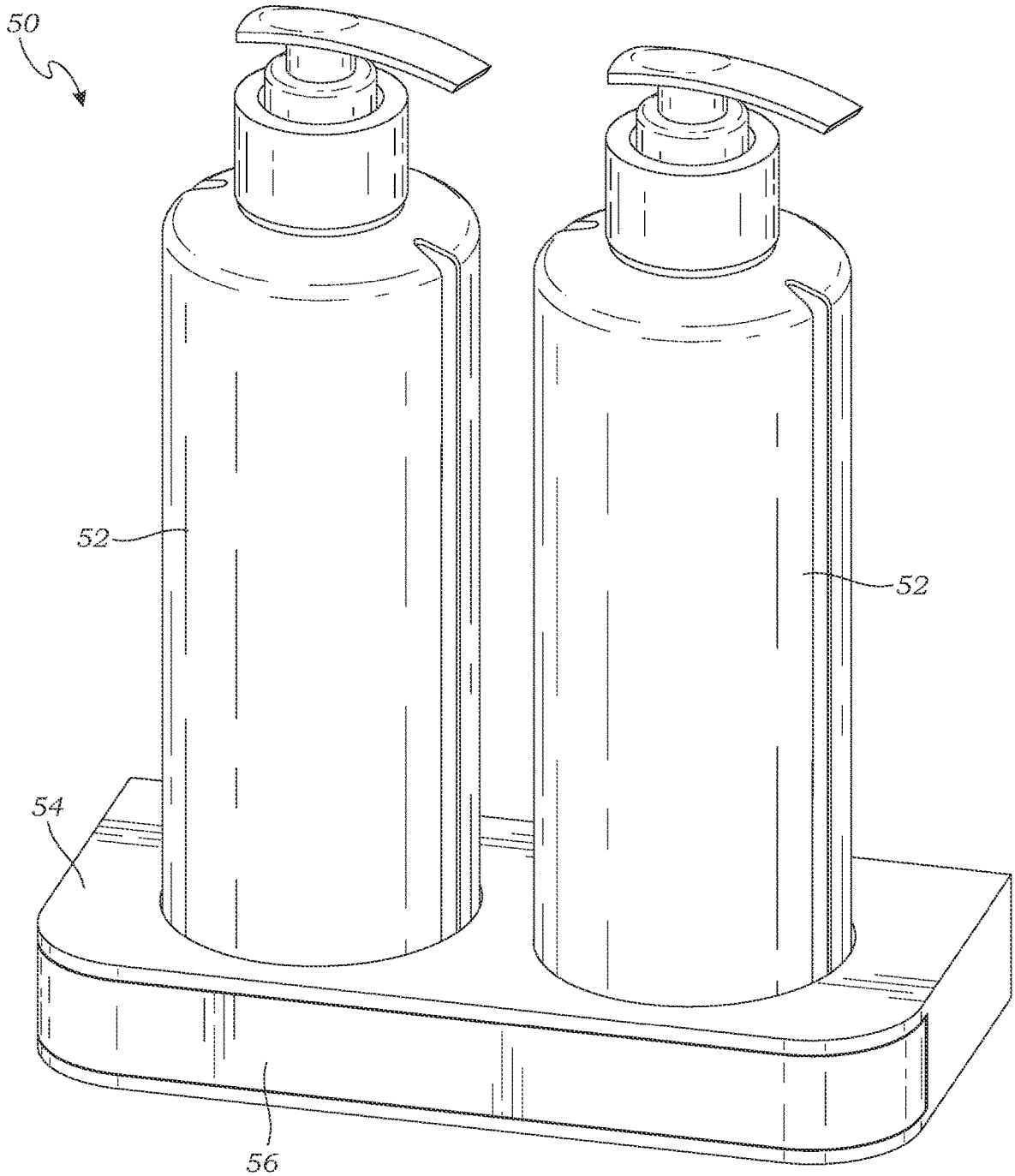
FIG. 4 is a perspective view of the liquid product dispenser of FIG. 3, illustrating two dispensing containers locked within the locking housing, with the locking arms shown in a closed, locked position.

FIG. 3 an exploded perspective view of a second embodiment of the liquid product dispenser 50. FIG. 4 is a perspective view of the liquid product dispenser 50 of FIG. 3, illustrating two dispensing containers 52 locked within a locking housing 54, with a locking arm 56 shown in a closed, locked position. In the embodiment of FIGS. 3-4, the locking housing 54 of this embodiment may include two or more container receiving spaces 58, and the locking arm 56 of this embodiment may have multiple shaped portions 58 for engaging the multiple containers 52.

Figure 5:
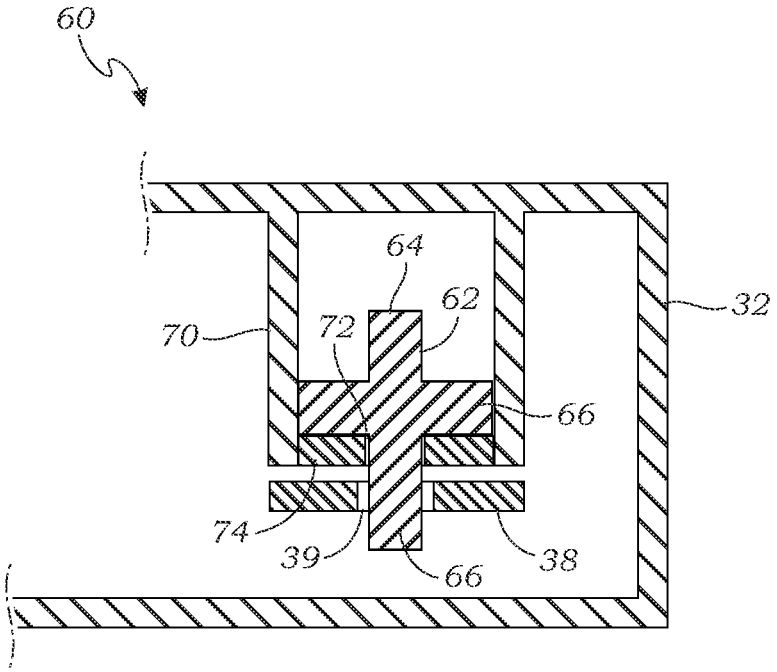
FIG. 5 is a sectional view thereof taken along line 5-5 in FIG. 1, illustrating a magnetic locking mechanism in a locked position.
Figure 6:
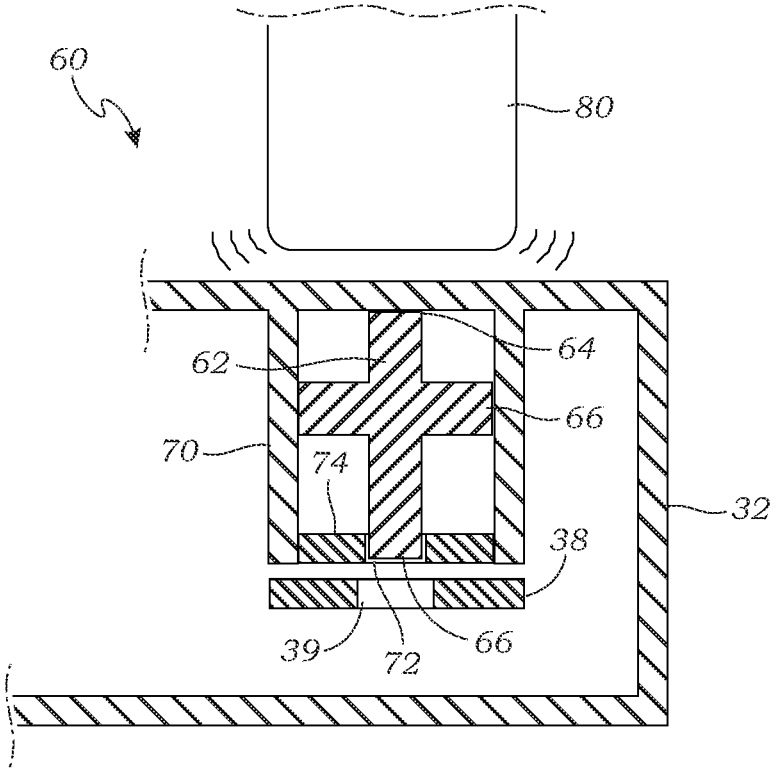
FIG. 6 is a sectional view similar to FIG. 5, illustrating the magnetic locking mechanism in an unlocked position.

FIG. 5 is a sectional view thereof taken along line 5-5 in FIG. 1, illustrating a magnetic locking mechanism 60 for locking the locking arm 34 (shown in FIGS. 1-2) in the closed, locked position. In FIG. 5, the locking mechanism 60 is illustrated in a locked position. FIG. 6 is a sectional view similar to FIG. 5, illustrating the magnetic locking mechanism 60 in an unlocked position. As shown in FIGS. 5-6, in this embodiment the magnetic locking mechanism 60 includes a locking post 62 having a top end 64 and a bottom end 66. The locking post 62 of this embodiment includes an annular flange 66 extending outwardly from the locking post, for supporting the locking post 62 in a lowered position (as shown in FIG. 5).

As shown in FIGS. 5-6, the magnetic locking mechanism 60 includes a receiving chamber 70 in the locking housing 32 positioned above the latch end 38 of the locking arm 34 (shown in FIGS. 1-2) when the locking arm 34 is in the closed, locked position. The receiving chamber 70 has an aperture 72 through a bottom wall 74 of the receiving chamber 70, and the bottom end 66 of the locking post 62 extends through the aperture 72 of the receiving chamber 70 so that the locking post 62 extends through the latch hole 39 of the latch end 38 of the locking arm 34 when the locking arm 34 is in the closed, locked position. The locking post 62 is able to move freely within the receiving chamber 70, so that an upwardly directed magnetic force supplied, for example, by a magnet 80 (shown in FIG. 6) is able to lift the locking post 62 (made of ferromagnetic material) upwardly to unlock the locking arm 34, wherein the bottom end 66 is disengaged from the latch hole 39 of the latch end 38. The magnetic locking mechanism 60 of this embodiment does not include a spring, which is required in prior art devices, which reduces expenses, especially in time to assemble, which is greatly simplified by this improved design.

The title of the present application, and the claims presented, do not limit what may be claimed in the future, based upon and supported by the present application. Furthermore, any features shown in any of the drawings may be combined with any features from any other drawings to form an invention which may be claimed.

As used in this application, the words "a," "an," and "one" are defined to include one or more of the referenced item(s) unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A mounting device for mounting a dispensing container on a counter-top, the dispensing container having an annular groove adjacent a bottom end of the dispensing container, the mounting device comprising:

a locking housing having a top structure and a bottom structure separated by a locking arm that is pivotally connected to the locking housing;

wherein the locking arm extends to a latch end having a latch hole, and the locking arm pivots between an open, unlocked position, and a closed, locked position, the locking arm;

an opening in the top structure of the locking housing that allows access to a container receiving space that is sized and shaped to receive the bottom end of the dispensing container therein;

wherein when the bottom end of the dispensing container is placed within the container receiving space, and the locking arm is moved to the closed, locked position, the locking arm engages the annular groove of the dispensing container to lock the dispensing container within the locking housing; and a magnetic locking mechanism for locking the locking arm in the closed, locked position, the magnetic locking mechanism comprising:

a locking post having a top end, a bottom end, and an annular flange extending outwardly from the locking post;

a receiving chamber in the locking housing positioned above the latch end of the locking arm when the locking arm is in the closed, locked position, the receiving chamber having an aperture through a bottom wall of the receiving chamber, positioned so that when the annular flange of the locking post is resting upon the bottom wall of the receiving chamber, the bottom end of the locking post extends through the aperture of the receiving chamber and through the latch hole of the latch end of the locking arm, so that the locking arm is secured in the closed, locked position by the locking post; and wherein the locking post is able to move freely within the receiving chamber, so that an upwardly directed magnetic force is able to lift the locking post upwardly to unlock the locking arm.

2. The mounting device of claim 1, further comprising an adhesive sheet bonded to a bottom surface of the bottom structure, for bonding the locking housing to the counter-top.

3. The mounting device of claim 1, wherein the magnetic locking mechanism does not include a spring.

4. A product dispenser for dispensing a liquid from a counter-top, the product dispenser comprising:

a dispensing container for containing and dispensing the liquid, the dispensing container having an annular groove adjacent a bottom end of the dispensing container;

a locking housing having a top structure and a bottom structure separated by a locking arm that is pivotally connected to the locking housing, so that the locking arm pivots between an open, unlocked position, and a closed, locked position, the locking arm extending to a latch end having a latch hole;

an opening in the top structure of the locking housing that allows access to a container receiving space that is sized and shaped to receive the bottom end of the dispensing container therein;

wherein when the bottom end of the dispensing container is placed within the container receiving space, and the locking arm is moved to the closed, locked position, the locking arm engages the annular groove of the dispensing container to lock the dispensing container within the locking housing;

an adhesive sheet bonded to a bottom surface of the bottom structure, for bonding the locking housing to the counter-top; and a magnetic locking mechanism for locking the locking arm in the closed, locked position, the magnetic locking mechanism comprising:

a locking post having a top end and a bottom end, the locking post having an annular flange extending outwardly from the locking post;

a receiving chamber in the locking housing positioned above the latch end of the locking arm when the locking arm is in the closed, locked position, the receiving chamber having an aperture through a bottom wall of the receiving chamber, wherein the bottom end of the locking post extends through the aperture of the receiving chamber so that the locking post extends through the latch hole of the latch end of the locking arm when the locking arm is in the closed, locked position; and wherein the locking post is able to move freely within the receiving chamber, so that an upwardly directed magnetic force is able to lift the locking post upwardly to unlock the locking arm.

* * * * *